US006155154A

United States Patent [19]

Hsu

[11] Patent Number: 6,155,154

[45] Date of Patent: Dec. 5, 2000

[54] QUICK POSITIONING DEVICE OF A BANK KNIFE

[76] Inventor: Yuan-Chang Hsu, No. 21, Alley 9, Lane 27, Sec. 5, Min Sheng E. Rd., Taipei, Taiwan

[21] Appl. No.: 09/273,226

[22] Filed: Mar. 20, 1999

[51] Int. Cl.[7] ..... B26D 1/14

[52] U.S. Cl. ..... 83/508.3; 83/698.31; 403/322.4

[58] Field of Search ..... 83/908.2, 508.3, 83/698.31, 698.41, 699.21, 699.31; 403/322.4, 325, 331

[56] References Cited

U.S. PATENT DOCUMENTS

| | | | |
|---|---|---|---|
| 4,077,291 | 3/1978 | Obenshain | 83/508.3 X |
| 4,827,828 | 5/1989 | Gurney | 403/322 X |
| 4,884,046 | 11/1989 | Spinner | 403/322 X |
| 5,090,281 | 2/1992 | Paulson et al. | 83/508.3 X |
| 5,322,384 | 6/1994 | Szirtes | 403/322 |
| 5,551,328 | 9/1996 | Hsu | 83/508.3 |
| 5,556,221 | 9/1996 | Brunner | 403/322 |
| 5,664,904 | 9/1997 | Hapgood et al. | 403/322 X |

*Primary Examiner*—M. Rachuba
*Attorney, Agent, or Firm*—Rosenberg, Klein & Lee

[57] ABSTRACT

A quick positioning device of a bank knife installed with a positioning device on one side of the knife seat body having a dovetail groove is disclosed. The positioning deuce comprising: a locking block pivotally installed on the knife seat body; an elastic element ejecting against the locking block; a handle pivotally installed on the knife seat body, one end of the handle being connected with linkages, one end of the linkages being connected to the locking block, another end of the handle being formed as a movable portion. When the knife seat body is located across the dovetail seat by the dovetail groove, by moving the movable portion of the handle, the linkage is driven to push the locking block so that the locking block will tightly resist against the dovetail seat. Thus the knife seat body may be positioned on the dovetail seat quickly.

6 Claims, 7 Drawing Sheets

QUICK POSITIONING DEVICE OF A BANK KNIFE

BACKGROUND OF THE INVENTION

1. Field of the Invention

The present invention relates to a quick positioning device of a bank knife, and specially to a positioning device which can be positioned to a dovetail seat, thereby, bank knife can be positioned and detached quickly.

2. Description of the Prior Art

Conventionally, a bank knife is used to cut all kinds of plastic sheet, plastic film paper, etc. so as to be cut according to a desired width. Therefore, the bank knife employs a plurality of parallel knife blades so to cut the object rapidly. For example, Taiwan Patent No. 208261 discloses a kind of bank knife.

As shown in FIG. 1, in one side of a prior art bank knife, a dovetail groove 11*a* is installed on one side of the knife seat body 10*a*. A pin 12*a* is pivotally installed to a locking block 13*a*. The dovetail groove 11*a* of the knife seat body 10*a* is located across a dovetail seat 14*a*. A stud 15*a* is screwedly installed to the knife seat body 10*a*. By rotating the stud 15*a*, the locking block 13*a* will tightly resist against the dovetail seat 14*a* so that the knife seat body 10 can be positioned properly as it is located across the knife seat body 10*a*.

However, since in the prior art positioning device of a bank knife, the locking block 13*a* will tightly resist against the dovetail seat 14*a* by rotating the stud 15*a*, the rotation of the stud 15*a* needs many labor hours, thus the bank knife is inconvenient to be positioned and detached. Moreover, when the stud 15*a* resists against the locking block 13*a* so to timely resist against the dovetail seat 14*a*, it can not assure that the contact surface 16*a* of the locking block 13*a* is flatly adhered to the contact surface 17*a* of the dovetail seat 14*a*. If the locking block 13*a* is inclined slightly, when the locking block 13*a* is locked, the bank knife is probably inclined, thus the positioning is improper.

SUMMARY OF THE INVENTION

Accordingly, the object of the present invention is to provide a quick positioning device of a bank knife installed with a positioning device on one side of the knife seat body having a dovetail groove, the positioning device comprising a locking block, an elastic element a handle and a linkage. In the present invention, by moving the handle and by a linkage, the locking and releasing of a locking block is controlled. Thus the bank knife can be positioned quickly to a dovetail seat. The moving of the handle is very rapid and convenient, thus the bank knife can be positioned and detached conveniently.

Another object of the present invention is to provide a quick positioning device of a bank knife. When the dovetail groove of the knife seat body across the dovetail seat and the handle has not been moved to control the locking block, the locking block can be pushed elastically by an elastic element so that the contact surface of the locking block is flatly adhered to the contact surface of the dovetail seat so as to have the function of guiding the locking block in advance. Thus, when moving the handle to control the locking block to tightly lock the positioning device, it is assured that the contact surface of the locking block is flatly adhered to the contact surface of the dovetail seat. Therefore, the event that the bank knife is askew and the position is improper.

A further object of the present invention is to provide a quick positioning device of a bank knife. An eccentric shaft of the handle is pivotally installed on the knife seat body and is fixed by a stud. The eccentric shaft also have the function of adjusting the clamping force of a locking block. When a locking means has been used for a long time period, then the eccentric shaft will rotate properly and adjust for compensation so as to retain the clamping force of the locking block. One end of the eccentric shaft is installed with a groove in order to prevent the rotation as the stud is tightly locked and thereby a screw opener can adjust the eccentric shaft conveniently for adjusting the clamping force.

The present invention will be better understood and its numerous objects and advantages will become apparent to those skilled in the art by referencing to the following drawings in which:

DETAILED DESCRIPTION OF THE PREFERRED EMBODIMENT

Figure 1:
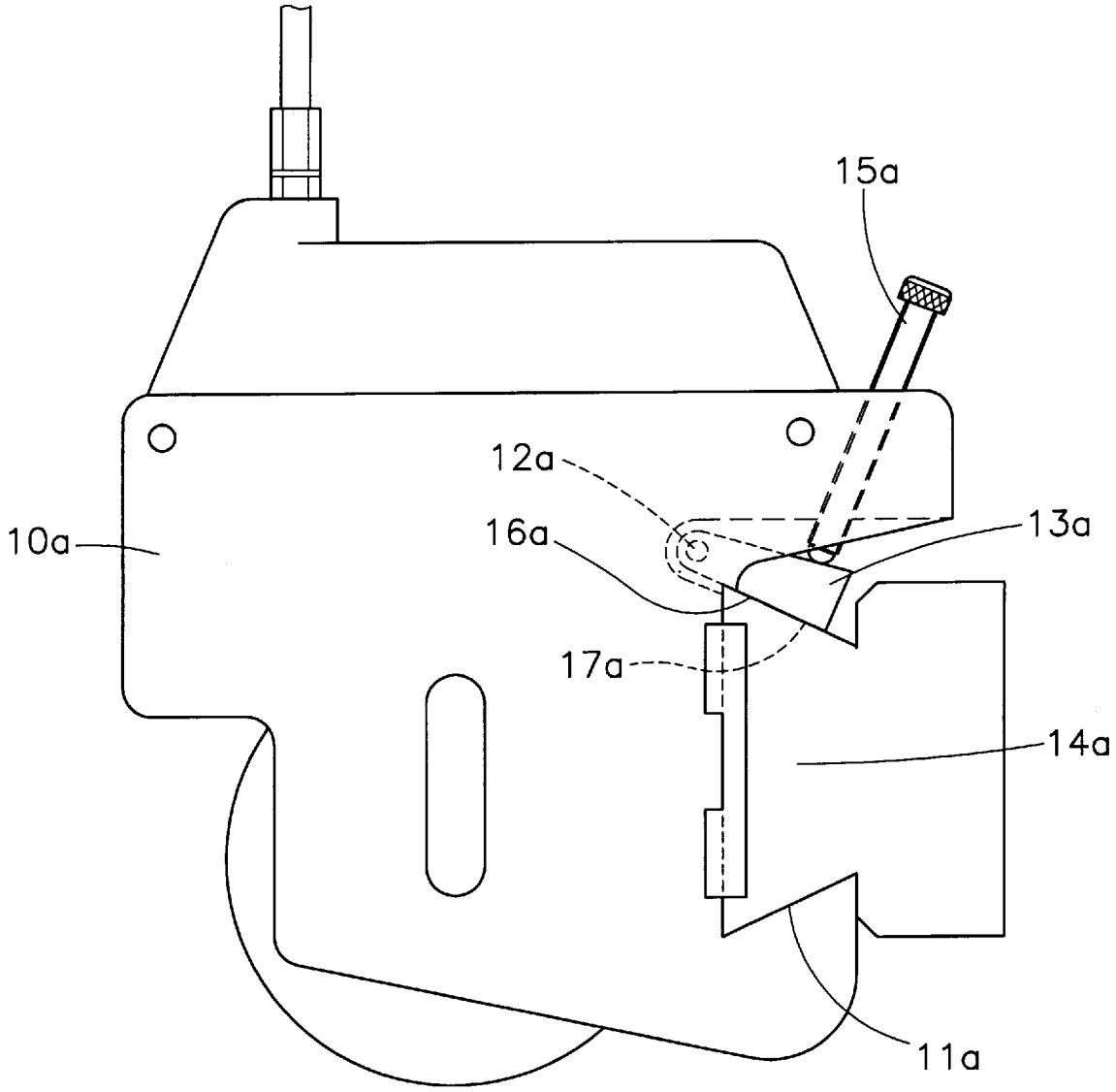
FIG. 1 PRIOR ART
FIG. 1 is a front view of a conventional quick positioning device of a bank knife.
Figure 2:
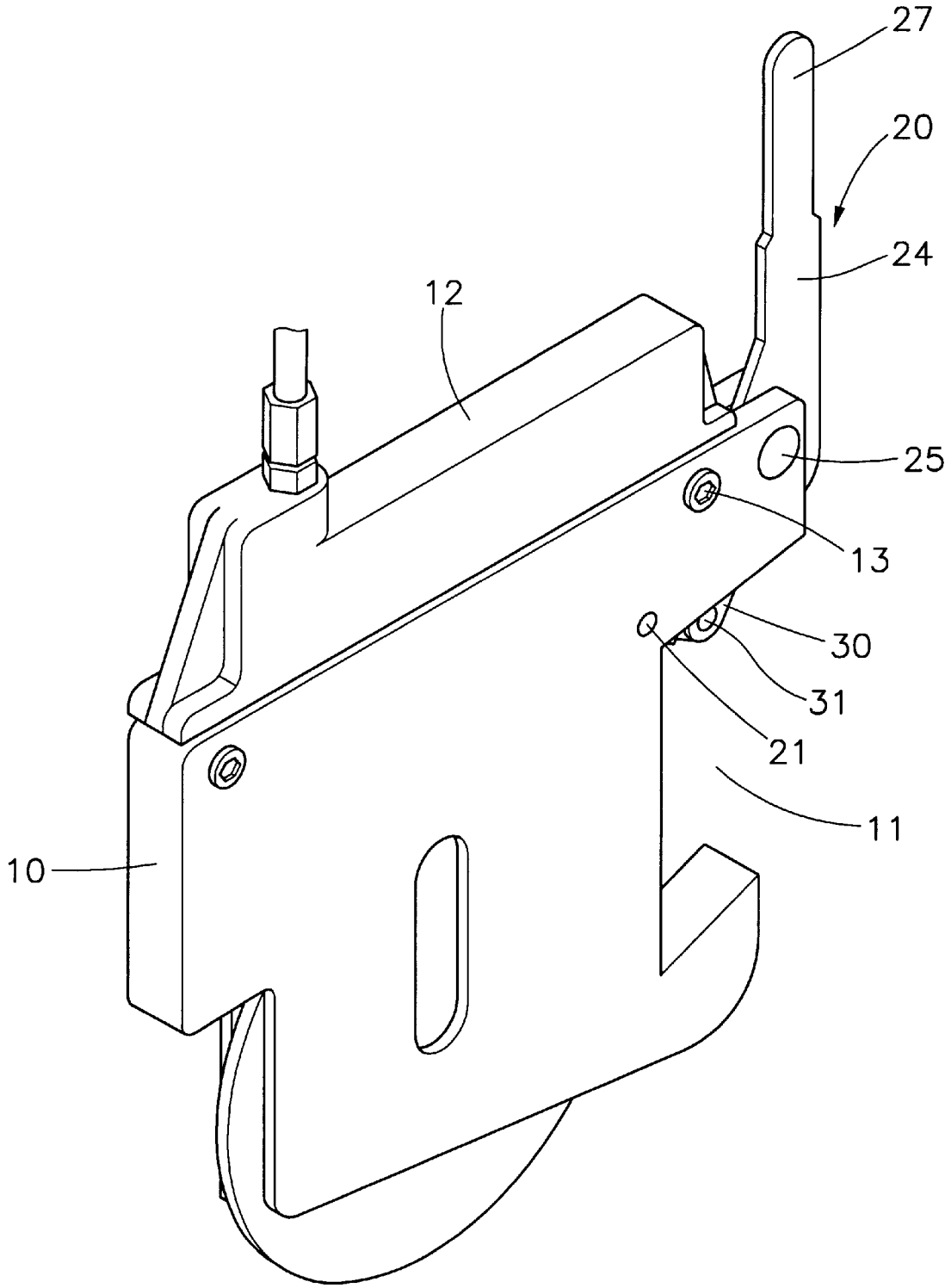
FIG. 2 is a perspective view of the present invention.
Figure 3:
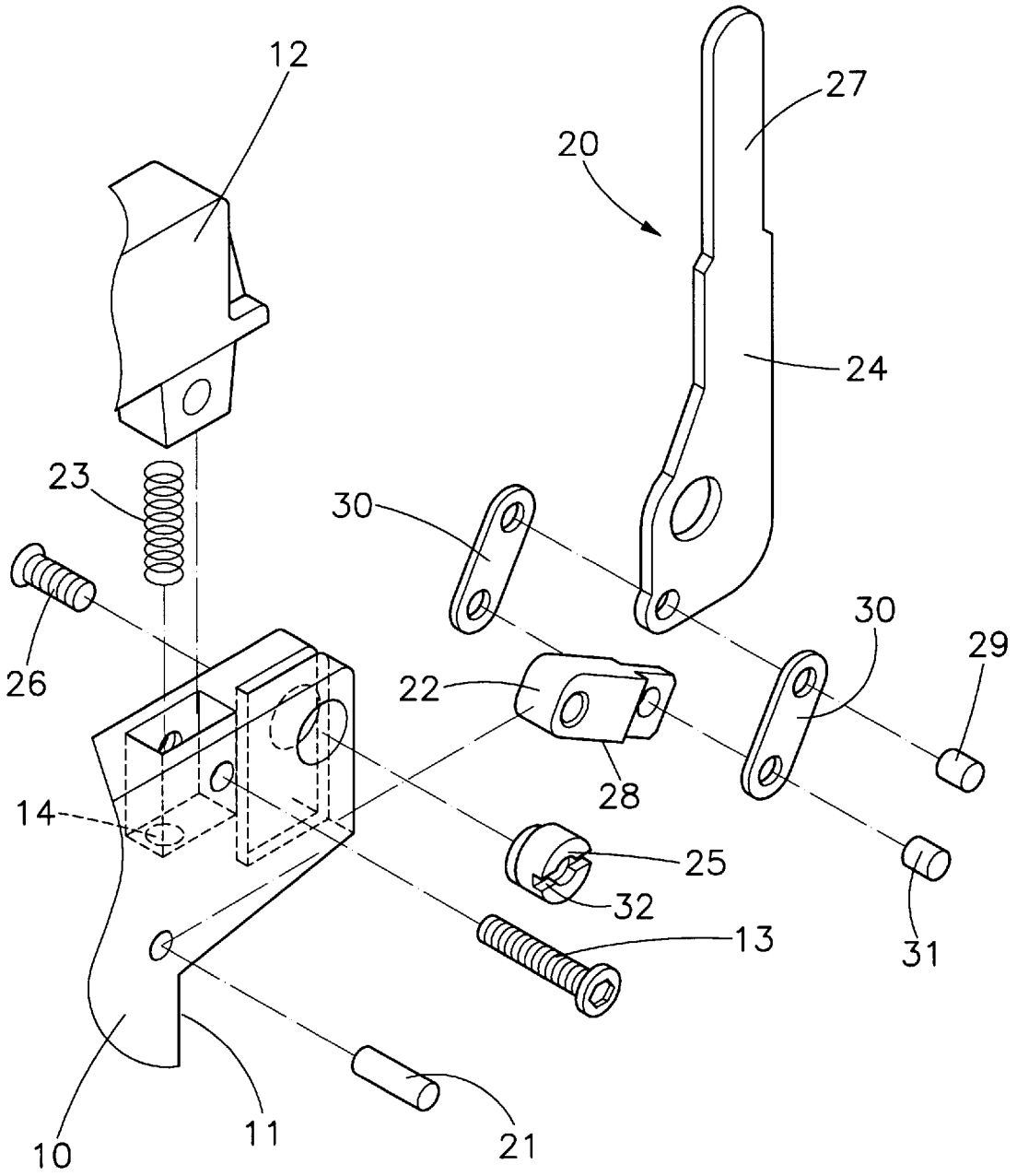
FIG. 3 is an exploded perspective view of the present invention.
Figure 6:
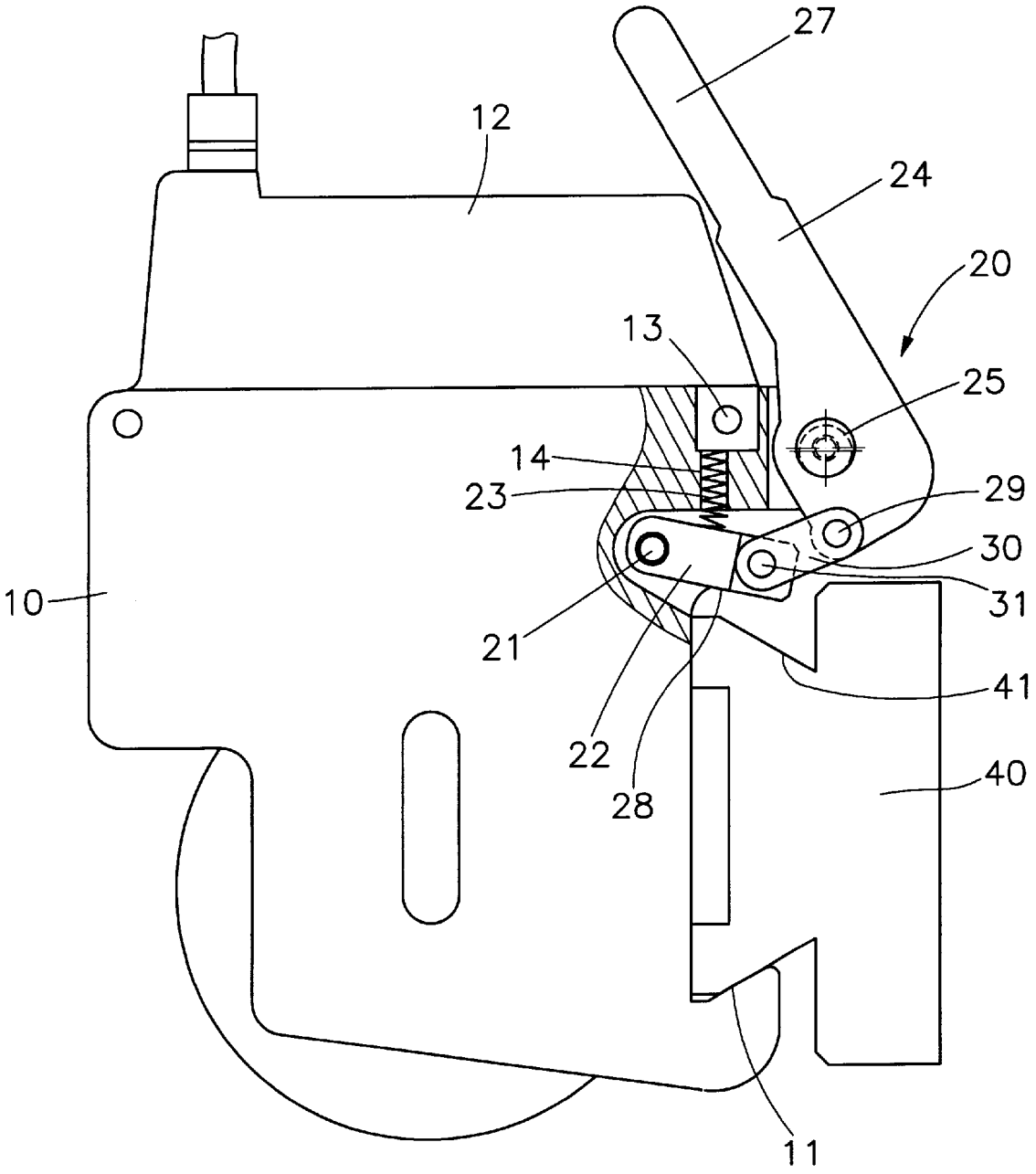
FIG. 6 is a front mew showing that the present invention is released from a dovetail seat.
Figure 7:
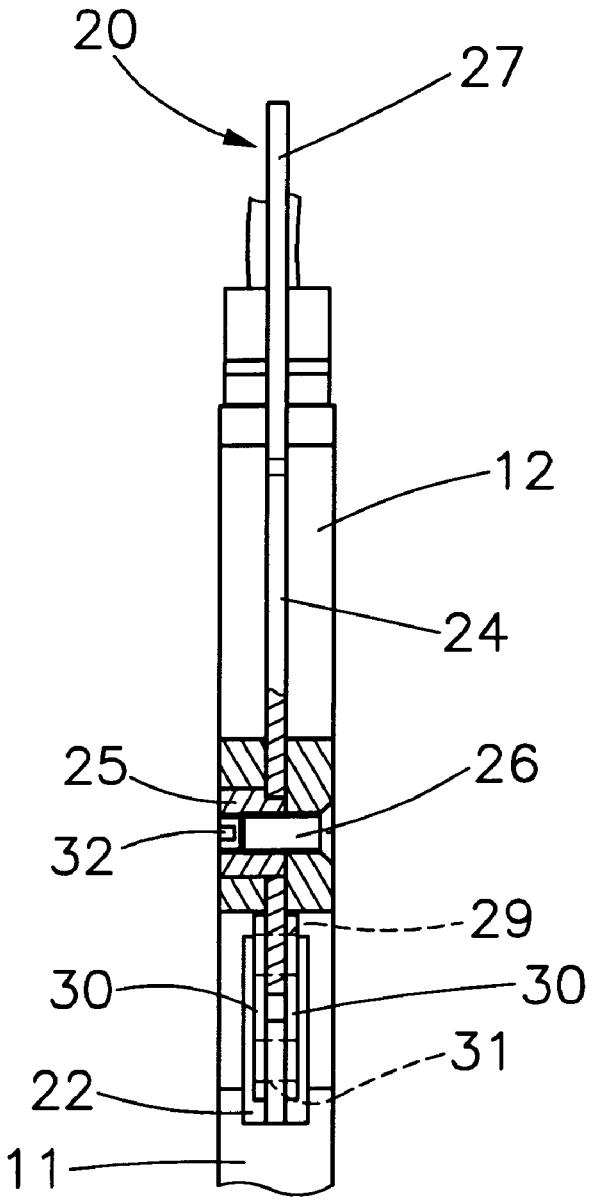
FIG. 7 is a side view of the present invention.

As shown in FIGS. 2, 3 and 7, the quick positioning device of a bank knife according to the present invention is illustrated. The knife seat body 10 of the bank knife has a dovetail groove 11, one the side having the dovetail groove 11 is installed with a positioning device 20 including a locking block 22. The locking block 22 is pivotally installed to the knife seat body 10 by a pivotal axis (with reference to FIGS. 5 and 6). The locking block 22 is located above the dovetail groove 11 of the knife seat body 10. The bottom of the locking block 22 is formed with a contact block 28. The locking block 22 can swing along the pivotal axis 21 as a fulcrum.

The locking block 22 is installed with an elastic element 23 thereabove. The elastic element 23 is received within a through hole 14 atop the knife seat body 10. The top of the knife seat body 10 is combined to an upper cover 12 by a screw 13. The upper cover 12 closes the top portion of the through hole 14 so that the elastic element 23 is fixed to the through hole 14. The bottom of the elastic element 23 is protruded from the through hole 14 to eject against the top of the locking block 22. Thereby, the elastic element 23 can push the locking block 22 to swing downwards.

A handle 24 is pivotally installed above the locking block 22. The handle 24 is pivotally installed on the knife seat body 10 by an eccentric shaft 25. The handle 24 may swing around the eccentric shaft 25 which is as a fulcrum. The eccentric shaft only need rotate to a proper angle and then is fixed by a stud 26. Thereby, it has an offset effect of the positioning device.

The handle 24 is pivotally connected with two linkages 30 by a pivotal axis 29. Another end of each linkage 30 is pivotally connected to the locking block 22 by a pivotal axis 31 so that the lower end of the handle 24 is connected to the locking block 22 by the linkages 30. The upper end of the handle 24 is formed with a movable portion 27. By moving the movable portion 27, the handle 24 will swing. By the aforementioned structure, a positioning device 20 is formed.

Figure 4:
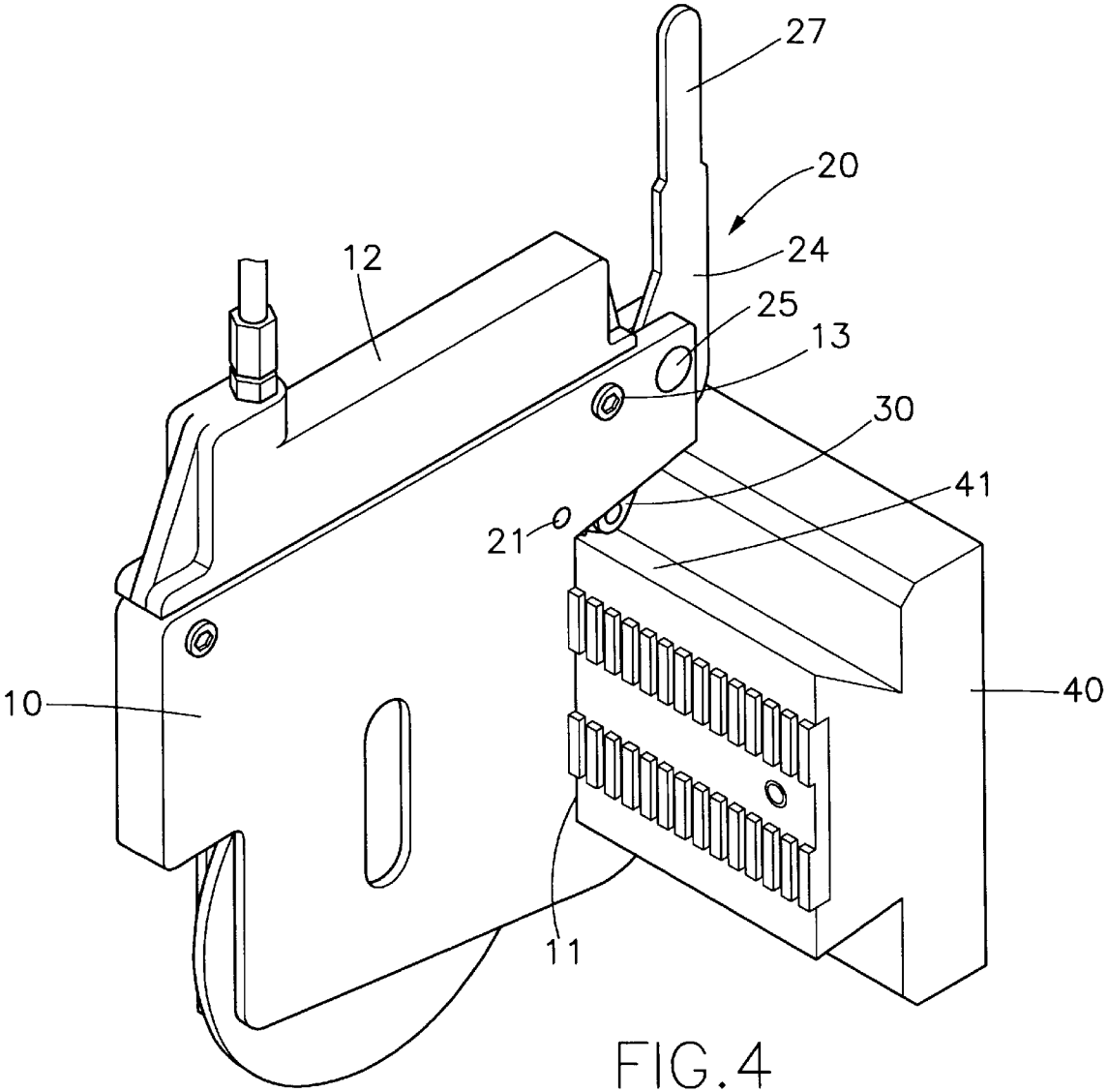
FIG. 4 is a perspective view showing that the present invention is tightly locked to a dovetail seat.
Figure 5:
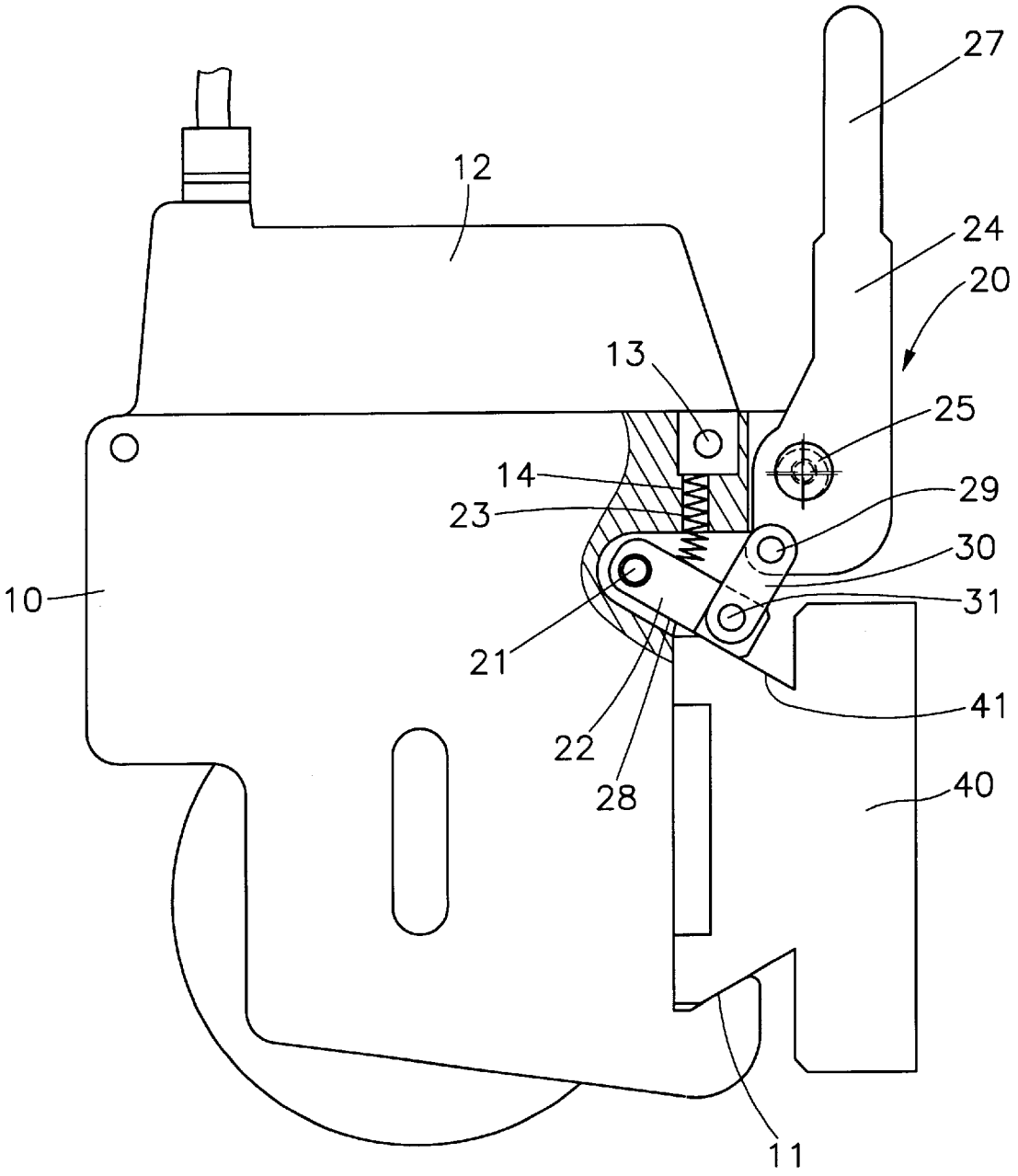
FIG. 5 is a front view showing that the present invention is tightly locked to a dovetail seat.

As shown in FIGS. 4 and 5, the knife seat body 10 can be located across the dovetail seat 40 by the dovetail groove 11, and by moving the movable portion 27 on the upper end of the handle 24, the linkages 30 will be driven to push the locking block 22 so that the contact surface 28 on the bottom of the locking block 22 tightly resists against the contact surface 41 of the dovetail seat 40. Thus, the knife seat body 10 across the dovetail seat 40 may be tightly locked in a proper time.

As shown in FIG. 6, in the present invention, by moving the movable portion 27 on the upper end of the handle 24, the linkages 30 will be driven to pull the locking block 22 so that the contact surface 28 of the locking block 22 will separate with the contact surface 41 of the dovetail seat 40, and thus the contact surface 28 on the bottom of the locking block 22 will release the force resisting against the contact surface 41 of the dovetail seat 40. Therefore, the knife seat body 10 across the dovetail seat 40 can be slidable adjusted or detached.

In the present invention, by the movement of the handle 24 and by the linkage 30, the locking and releasing of the locking block 22 can be controlled, thus the effect of quick positioning is achieved. Therefore, the bank knife can be positioned on the dovetail seat 40 quickly. The movement of the handle 24 is very quick and easy. Thus, the bank knife can be positioned and detached. Moreover, in the present invention, when the dovetail groove 11 of the knife seat body 10 across the dovetail seat 40 and the handle 24 has not been moved to control locking block 22 to tightly lock, the locking block 22 can be pushed downwards elastically by an elastic element 23 so that the contact surface 28 of the locking block 22 is flatly adhered to the contact surface 41 of the dovetail seat 40 so as to have the function of guiding the locking block 22 in advance. Thus, when moving the handle 24 to control the locking block 22 to tightly lock the position device, it is assured that the contact surface 28 of the locking block 22 is flatly adhered to the contact surface 41 of the dovetail seat 40. Therefore, misalignments wherein the bank knife is askew and the position is improper are avoided.

Furthermore, other than fixing a handle 24, the eccentric shaft also have the function of adjusting the clamping force of a locking block 22. For example, when a locking means has been used for a long time period, all the connections will loosen by friction, then the eccentric shaft will rotate properly and adjust for compensation so as to retain the clamping force of the locking block 22. One end of the eccentric shaft 25 is installed with a groove 32 in order to prevent the rotation as the stud 26 is tightly locked and thereby a screw opener can adjust the eccentric shaft 25 conveniently for adjusting the clamping force.

Although the present invention has been described using specified embodiment, the examples are meant to be illustrative and not restrictive. It is clear that many other variations would be possible without departing from the basic approach, demonstrated in the present invention. Therefore, all such variations are intended to be embraced within the scope of the invention as defined in the appended claims.

Description of the Numerals in Figures

| | | | |
|---|---|---|---|
| 10 | Knife seat body | 11 | Dovetail groove |
| 12 | Upper cover | 13 | Screw |
| 14 | Through hole | | |
| 20 | Positioning device | 21 | Pivotal axis |
| 22 | Locking block | 23 | Elastic element |
| 24 | Handle | 25 | Eccentric shaft |
| 26 | Stud | 27 | Movable portion |
| 28 | Contact surface | 29 | Pivotal axis |
| 30 | Linkage | 31 | Pivotal axis |
| 32 | Groove | | |
| 40 | Dovetail seat | 41 | Contact surface |
| 10a | Knife seat body | 11a | Dovetail groove |
| 12a | Pin | 13a | Locking block |
| 14a | Dovetail seat | 15a | Stud |
| 16a | Contact surface | 17a | Contact surface |

What is claimed is:

1. A bank knife system for adjustable coupling to a dovetail seat comprising:

(a) a knife seat body adapted to slidably engage the dovetail seat;

(b) a longitudinally extended locking block having longitudinally offset first and second coupling portions and a longitudinal contact surface portion for contacting an inclined surface of the dovetail seat, said first coupling portion being pivotally coupled to said knife seat body;

(c) an elastic element coupled to said knife seat body and said locking block for resiliently biasing said contact surface portion of said locking block into substantially flush engagement of the dovetail seat;

(d) a handle member coupled to said knife seat body in pivotally displaceable manner about a pivot axis;

(e) an adjustable shaft assembly coupled to said handle member and said knife seat body for adjustably defining said pivot axis for said handle member; and, (f) at least one linkage member pivotally coupled to said handle member and said second coupling portion of said locking block for displacing said locking block responsive to said pivotal displacement of said handle member relative to said knife body seat;

whereby said knife seat body is releasably secured to the dovetail seat.

2. The bank knife system as recited in claim 1 wherein said shaft assembly includes an eccentric shaft member disposed in angularly adjustable manner relative to said handle member for displacing said pivot axis thereof.

3. The bank knife system as recited in claim 2 wherein said eccentric shaft has formed therein a radially directed groove.

4. The bank knife system as recited in claim 1 wherein said contact surface portion is formed along a bottom surface of said locking block.

5. The bank knife system as recited in claim 1 wherein said elastic element is received within a through hole formed in said knife seat body to partially protrude therefrom and engage said locking block.

6. The bank knife system as recited in claim 5 wherein said elastic element depressively engages said locking block.

* * * * *